US009484641B2

(12) United States Patent
Ohkubo et al.

(10) Patent No.: US 9,484,641 B2
(45) Date of Patent: Nov. 1, 2016

(54) FEMALE TERMINAL

(71) Applicant: YAZAKI CORPORATION, Tokyo (JP)

(72) Inventors: Yoshitaka Ohkubo, Shizuoka (JP); Shuhei Ando, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/960,843

(22) Filed: Dec. 7, 2015

(65) Prior Publication Data

US 2016/0087351 A1 Mar. 24, 2016

Related U.S. Application Data

(63) Continuation of application No. PCT/JP2014/065041, filed on Jun. 6, 2014.

(30) Foreign Application Priority Data

Jun. 7, 2013 (JP) ..... 2013-120964

(51) Int. Cl.
*H01R 13/62* (2006.01)
*H01R 4/18* (2006.01)
(Continued)

(52) U.S. Cl.
CPC ..... *H01R 4/183* (2013.01); *H01R 13/187* (2013.01); *H01R 13/213* (2013.01); *H01R 2101/00* (2013.01)

(58) Field of Classification Search
CPC H01R 13/625; H01R 13/623; H01R 13/187; H01R 13/20; H01R 13/111; H01R 2103/00
USPC ..... 439/314, 319, 843, 836
See application file for complete search history.

(56) References Cited

U.S. PATENT DOCUMENTS 5,449,304 A * 9/1995 Huss, Jr. ..... H01R 13/18 439/825
5,735,716 A 4/1998 Bilezikjian
(Continued)

FOREIGN PATENT DOCUMENTS

JP 64-43979 A 2/1989
JP 4209775 B2 1/2009
(Continued)

OTHER PUBLICATIONS

International Search Report and Written Opinion of the International Search Report for PCT/JP2014/065041 dated Jul. 15, 2014.
(Continued)

*Primary Examiner* — Hien Vu
(74) *Attorney, Agent, or Firm* — Kenealy Vaidya LLP

(57) ABSTRACT

A female terminal includes a terminal body having a contact holder in a tubular shape at a front side of the terminal body, a contact member in a tubular shape which is contained inside the contact holder and into which a male terminal is inserted from a front side, and a rotary ring which is mounted to the contact holder. The contact member has a pair of holding rings provided at both ends thereof, and a diameter variable part held by a pair of the holding rings at both ends thereof, an inner diameter of the diameter variable part being set to be larger than an outer diameter of the male terminal in an initial state, and contracted to be smaller than the outer diameter of the male terminal, by twisting a pair of the holding rings.

4 Claims, 9 Drawing Sheets

(51) Int. Cl.

| | |
|---|---|
| ***H01R 13/187*** | (2006.01) |
| *H01R 13/213* | (2006.01) |
| *H01R 101/00* | (2006.01) |

(56) References Cited

U.S. PATENT DOCUMENTS

| | | | | |
|---|---|---|---|---|
| 6,899,571 | B1 | 5/2005 | Koch et al. | |
| 8,142,238 | B2 * | 3/2012 | Heigl | H01R 13/111 439/843 |
| 8,597,065 | B2 * | 12/2013 | Mounier | H01R 13/193 439/843 |
| 8,840,436 | B2 * | 9/2014 | Mott | H01R 13/111 439/843 |
| 2003/0068931 | A1 | 4/2003 | Swearingen et al. | |
| 2003/0077950 | A1 | 4/2003 | Swearingen et al. | |
| 2004/0003498 | A1 | 1/2004 | Swearingen et al. | |
| 2013/0012047 | A1 | 1/2013 | Ishikawa et al. | |

FOREIGN PATENT DOCUMENTS

| | | | |
|---|---|---|---|
| JP | 2010-129358 | A | 6/2010 |
| JP | 2011-198617 | A | 10/2011 |
| JP | 2013-187166 | A | 9/2013 |
| JP | 2013-187167 | A | 9/2013 |
| WO | 2011/118656 | A1 | 9/2011 |

OTHER PUBLICATIONS

International Preliminary Report on Patentability and English language Written Opinion of the International Search Report for PCT/JP2014/065041.

* cited by examiner

FEMALE TERMINAL

CROSS REFERENCE TO RELATED APPLICATIONS

This application is a continuation of PCT application No. PCT/JP2014/065041, which was filed on Jun. 6, 2014 based on Japanese Patent Application (No. 2013-120964) filed on Jun. 7, 2013, the contents of which are incorporated herein by reference.

BACKGROUND OF THE INVENTION

1. Field of the Invention

The present invention relates to a female terminal into which a pin-shaped male terminal is inserted from a front side.

2. Description of the Related Art

In Japanese Patent Publication No. 4209775, there is disclosed an example of a female terminal which is provided with a contact member having elasticity in a radial direction. As shown in FIGS. 9 and 10, this female terminal 10 has a cylindrical sleeve 20, and a cylindrical contact member 30 which is inserted into the sleeve 20. A plurality of engaging parts 21 are provided at an interval in a circumferential direction, at both ends in an axial direction of the cylindrical sleeve 20. Moreover, the cylindrical contact member 30 is provided with a plurality of contact strips (small strips for contacts) 31 extending in the axial direction, and also provided with a plurality of engaging parts 32 which are arranged at an interval in a circumferential direction, at both ends thereof in the axial direction.

By engaging the engaging parts 32 at the both ends of the cylindrical contact member 30 with the engaging parts 21 at the both ends of the cylindrical sleeve 20 in a twisted positional relation, an assembly of a plurality of the contact strips 31 which are held in a twisted state is formed into a hyperboloid. Then, a part curved in a convex shape inward of the hyperboloid which is formed by the cylindrical contact member 30 functions as a spring part having elasticity in a radial direction, and thus, the female terminal 10 is formed. When a male terminal, which is not shown, is inserted into this female terminal 10, the contact member 30 is pressed with the male terminal and applies a contact load to the male terminal, while being elastically deformed, thereby to establish electrical connection between the male terminal and the female terminal.

By the way, in case of the female terminal as described above, the contact member has been set in a hyperboloidal shape, in advance, before the male terminal is inserted. Therefore, the male terminal must be inserted into the female terminal while being subjected to a spring load by the contact member. Accordingly, there is such a problem that the spring load causes a friction resistance, and an insertion load is increased. Moreover, there is another problem that a contact part between the male terminal and the female terminal tends to wear, because the male terminal is inserted while being subjected to the friction resistance.

In view of the above, an object of the present invention is to solve the above described problems, and to provide a female terminal capable of reducing a friction resistance when a male terminal is inserted, thereby to reduce an insertion load, and at the same time, to reduce wear of a contact part.

SUMMARY

The above described object is attained by the following structure.

(1) A female terminal including a terminal body having a contact holder in a tubular shape at a front side, a contact member in a tubular shape which is contained inside the contact holder and into which a male terminal is inserted from a front side, and a rotary ring which is rotatably mounted to the contact holder, wherein the contact member has a pair of holding rings which are provided at both ends thereof, and a diameter variable part which is held by a pair of the holding rings at both ends thereof, an inner diameter of the diameter variable part being set to be larger than an outer diameter of the male terminal in an initial state, and contracted to be smaller than the outer diameter of the male terminal, by twisting a pair of the holding rings in opposite directions relative to each other, and in a state where the contact member is contained inside the contact holder, one of the holding rings at the both ends is fixed to the contact holder so as not to rotate, while the other holding ring is fixed to the contact holder so as to rotate, and also fixed to the rotary ring so as to rotate integrally with the rotary ring.

(2) A female terminal as described above in item (1), wherein the diameter variable part includes a plurality of metal wires which are arranged at an interval in a circumferential direction in a state where their both ends are fixed to the holding rings, and extended in parallel with an axial direction of the contact member in the initial state, and when a pair of the holding rings are twisted relatively to each other, the metal wires are formed into a hyperboloid as a whole from the initial state.

(3) A female terminal as described above in item (1) or (2), wherein there is provided a fixing mechanism for fixing a rotation position of the rotary ring with respect to the contact holder, when the male terminal is inserted into the contact member and electrically connected.

(4) A female terminal as described above in item (3), wherein the fixing mechanism has a locking projection which is provided on a peripheral face of the contact holder, and a locking groove which is provided on a peripheral face of the rotary ring and receives the locking projection thereby to restrain movement in a rotation direction.

According to the female terminal having the structure as described above in item (1), the inner diameter of the diameter variable part of the tubular contact member is set to be larger than the outer diameter of the male terminal which is inserted into the contact member. Therefore, it is possible to insert the male terminal into the tubular contact member of the female terminal, while securing a gap with respect to the contact member. Consequently, the male terminal can be inserted into the female terminal with almost no friction resistance with respect to the contact member, and it is possible to reduce an insertion resistance, and also to reduce a wear of the contact part. Moreover, the diameter variable part of the contact member can be reduced in diameter, by rotating the rotary ring after the male terminal is inserted, and by twisting the other holding ring of the contact member with respect to the one holding ring. As the results, it is possible to bring the inner periphery of the diameter variable part into pressure contact with the outer periphery of the male terminal, thereby to establish electrically stabilized connection between the female terminal and the male terminal.

According to the female terminal having the structure as described above in item (2), by twisting the holding rings at the both ends relatively to each other, it is possible to position a plurality of the metal wires on the hyperboloid, and hence, a number of the metal wires can be brought into pressure contact with the outer periphery of the male terminal at the smallest inner diameter position of the hyperboloid. Therefore, a number of contact points (contact points between the metal wires and the male terminal) are present along an entire circumference. As the results, a stabilized contact state can be obtained between the male terminal and the female terminal, and a temperature rise of the contact part can be reduced. Further, because a curved degree of the hyperboloid can be varied according to a twisting angle, contact loads of the metal wires with respect to the male terminal can be varied, and therefore, it is possible to easily manage the contact resistance.

According to the female terminal having the structure as described above in item (3), it is possible to stably maintain the electrically connected state between the male terminal and the female terminal.

According to the female terminal having the structure as described above in item (4), it is possible to stably maintain the electrically connected state between the male terminal and the female terminal employing a simple structure.

According to the invention, when the male terminal is inserted into the tubular contact member which constitutes the female terminal, a gap can be secured between the contact member and the male terminal, and thus, the friction resistance at a time of insertion can be reduced. Therefore, the insertion load can be reduced, and wear of the contact part can be also reduced. Moreover, by simply rotating the rotary ring after the male terminal is inserted, it is possible to reduce the diameter of the diameter variable part of the contact member, thereby to bring the contact member into pressure contact with the male terminal In this manner, it is possible to electrically connect the female terminal with the male terminal.

The invention has been heretofore briefly described. Details of the invention will be further made clear, by reading through a mode for carrying out the invention (hereinafter referred to as "an embodiment") which will be described below, referring to the attached drawings.

BRIEF DESCRIPTION OF THE DRAWINGS

FIGS. 2A and 2B are perspective views showing the female terminal in FIG. 1, in a state divided into halves along a sectional plane in a longitudinal direction, of which FIG. 2A is a view showing an initial state where a contact member is not twisted, and FIG. 2B is a view showing a state where the contact member is twisted thereby to deform a diameter variable part into a hyperboloidal shape.

FIGS. 3A and 3B are perspective views showing the contact member which is used in the female terminal in FIG. 1, of which FIG. 3A is a view showing the initial state where the contact member is not twisted, and FIG. 3B is a view showing the state where the contact member is twisted thereby to deform the diameter variable part into the hyperboloidal shape.

FIGS. 4A and 4B are sectional side views of the female terminal in FIG. 1, of which FIG. 4A is a view showing the initial state where the contact member is not twisted, and FIG. 4B is a view showing the state where the contact member is twisted thereby to deform the diameter variable part into the hyperboloidal shape.

FIGS. 6A and 6B are sectional side views showing a state where the male terminal is inserted into the female terminal in FIG. 1, of which FIG. 6A is a view showing the initial state where the contact member is not twisted, and FIG. 6B is a view showing the state where the contact member is twisted thereby to deform the diameter variable part into the hyperboloidal shape.

DETAILED DESCRIPTION OF EMBODIMENT

Figure 1:
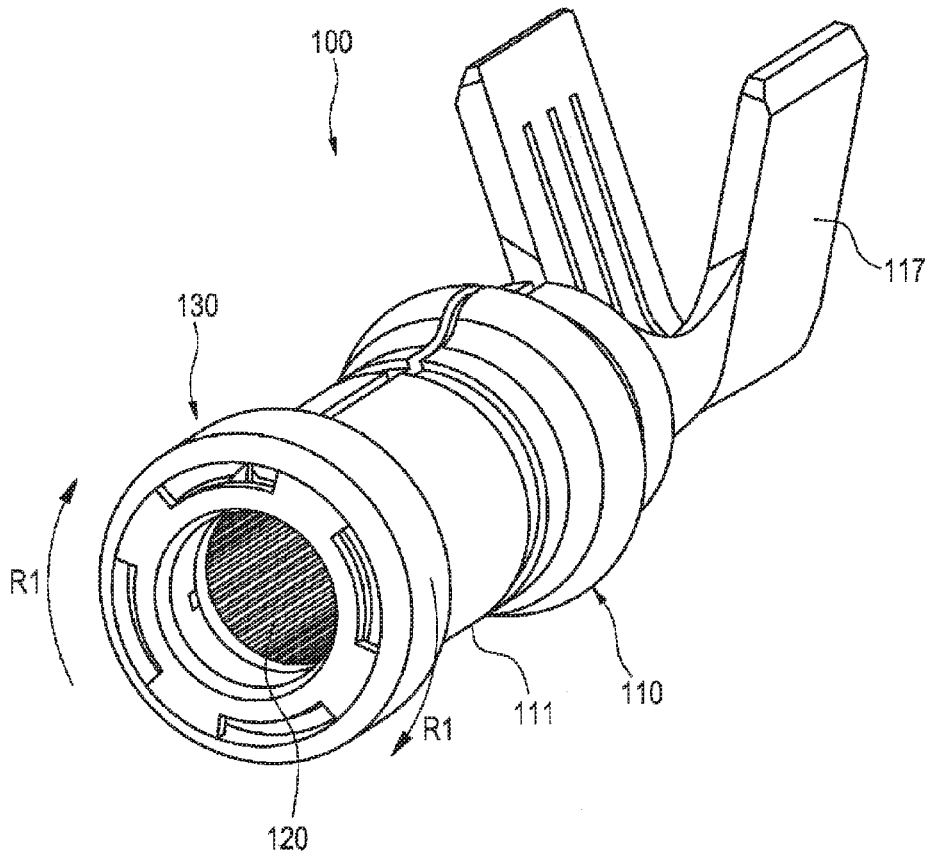
FIG. 1 is a perspective view showing a structure of a female terminal in an embodiment according to the invention.

An embodiment according to the invention will be described below, referring to the drawings.

Figure 2A:
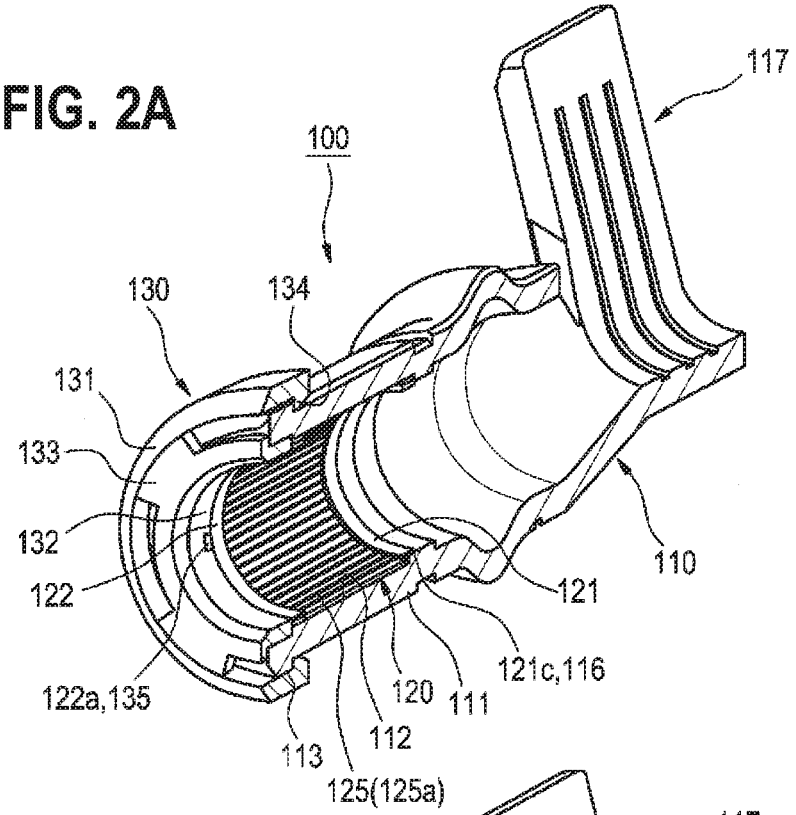
Figure 2B:
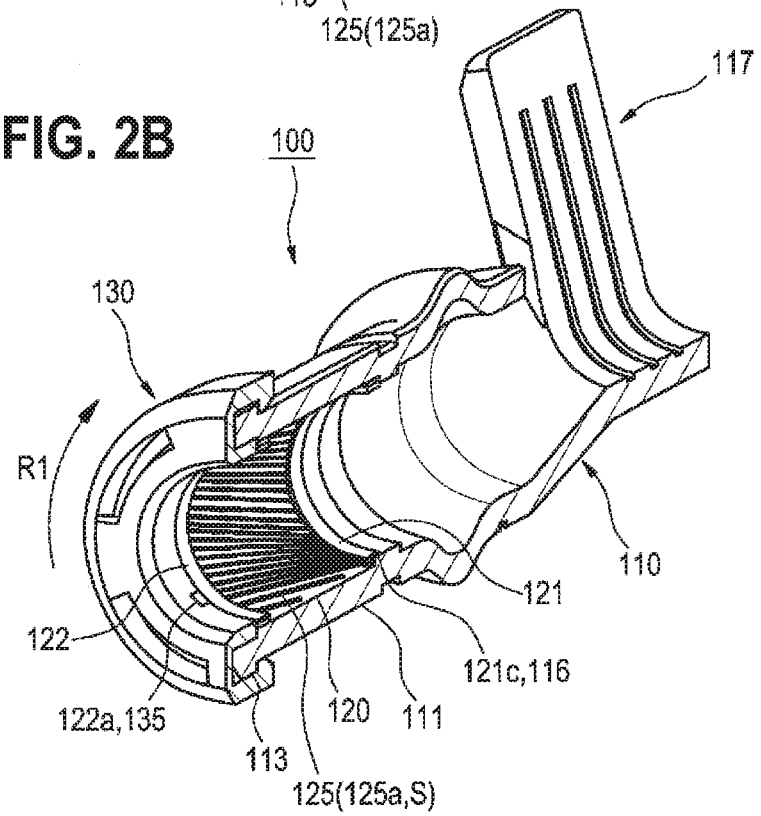
Figure 3A:
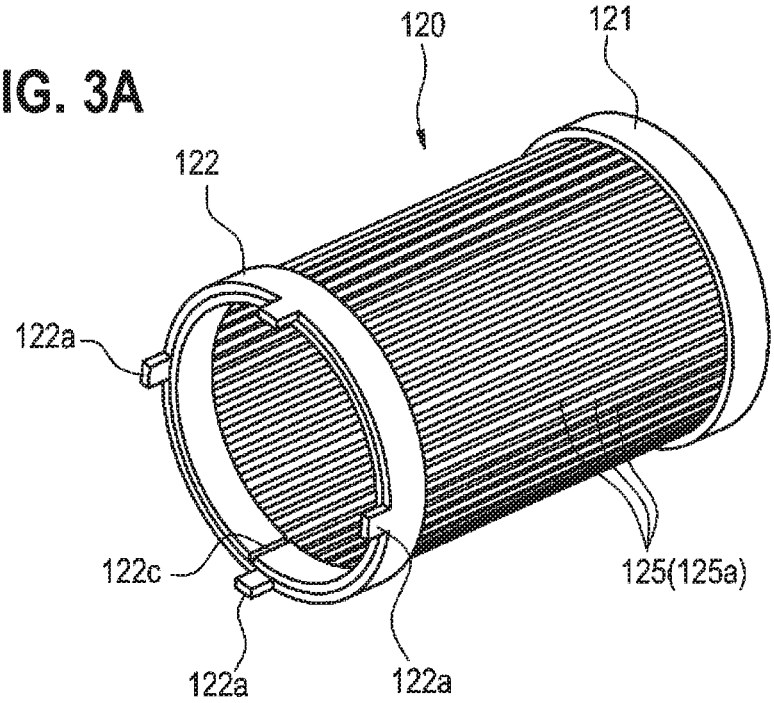
Figure 3B:
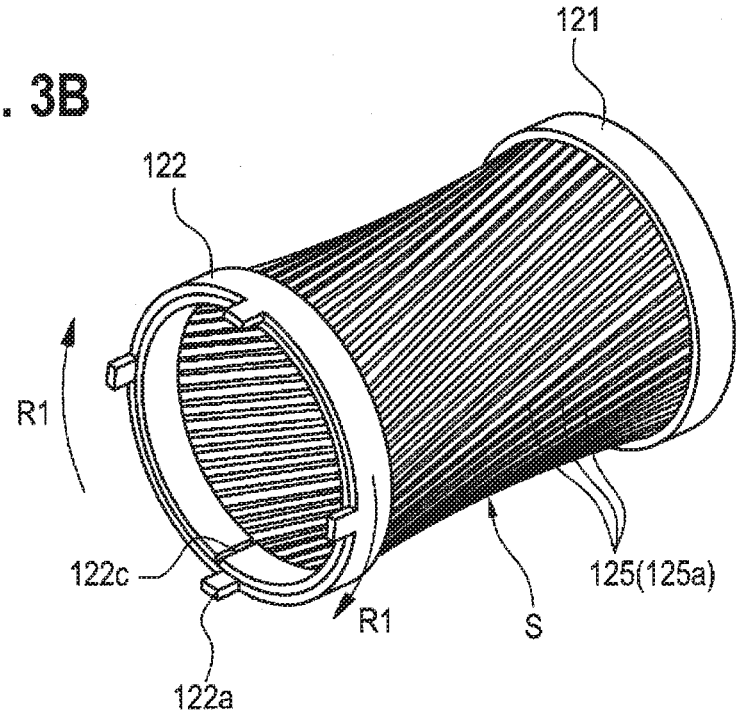
Figure 4A:
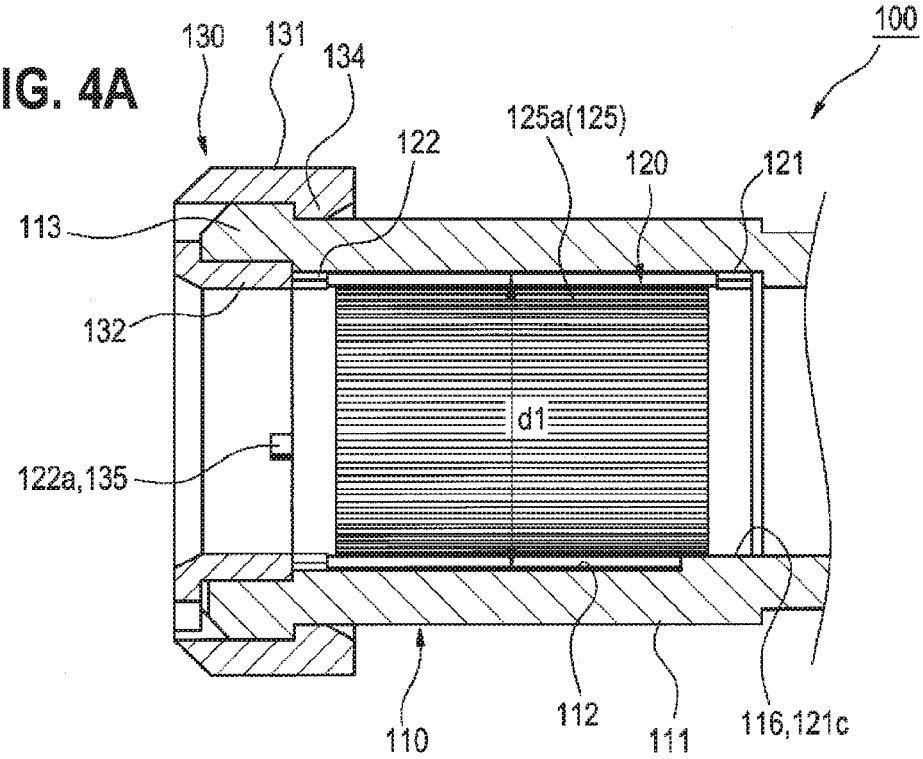
Figure 4B:
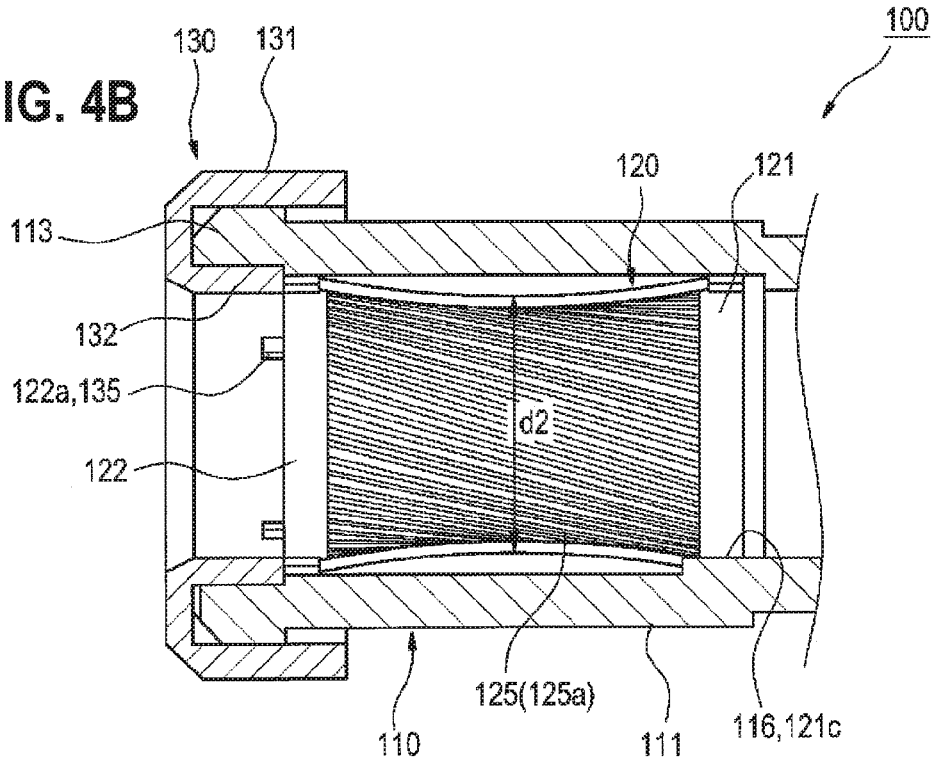
Figure 5:
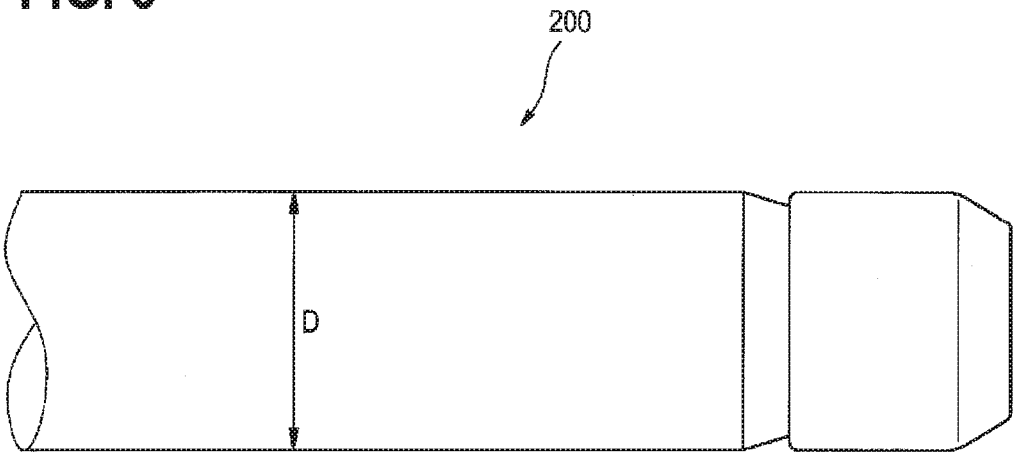
FIG. 5 is a side view showing a structure of a distal end part of a male terminal to be engaged with the female terminal in FIG. 1.
Figure 6A:
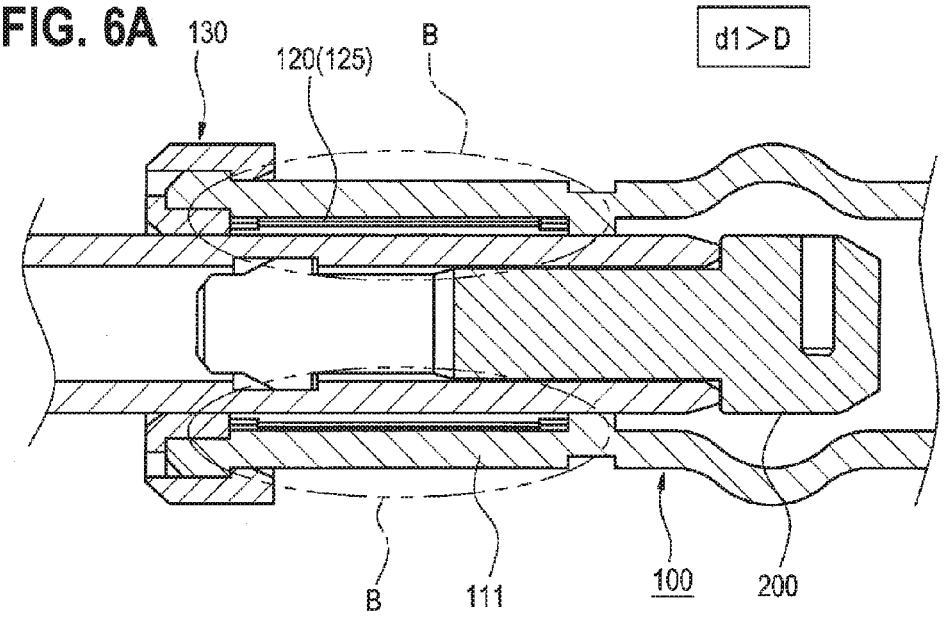
Figure 6B:
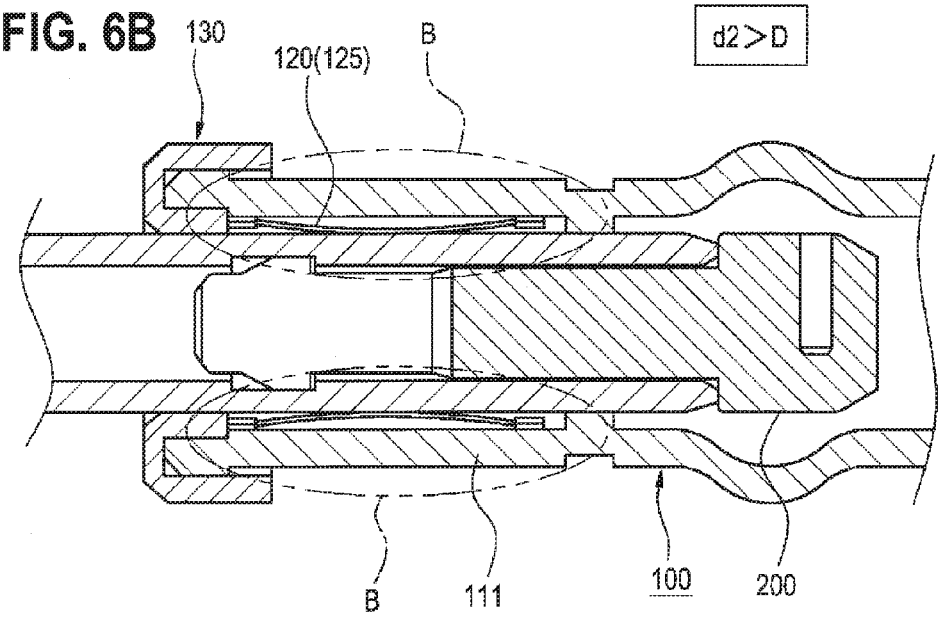
Figure 7A:
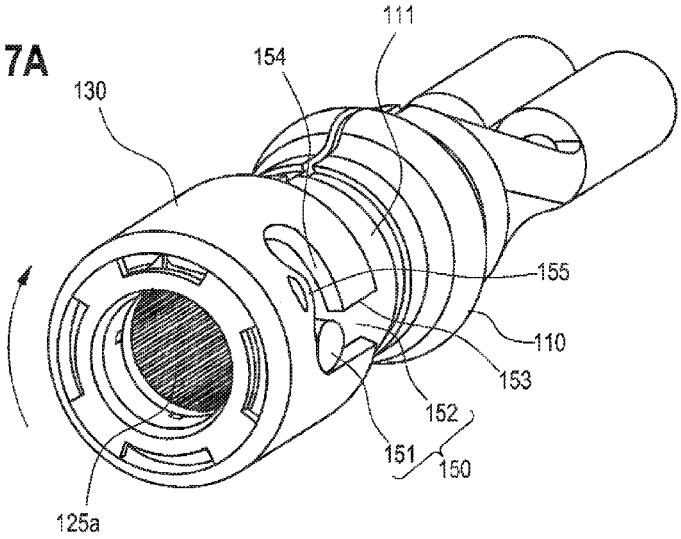
FIG. 7A is a perspective view showing a state before a rotary ring is fixed to a contact holder by means of a fixing mechanism.
Figure 7B:
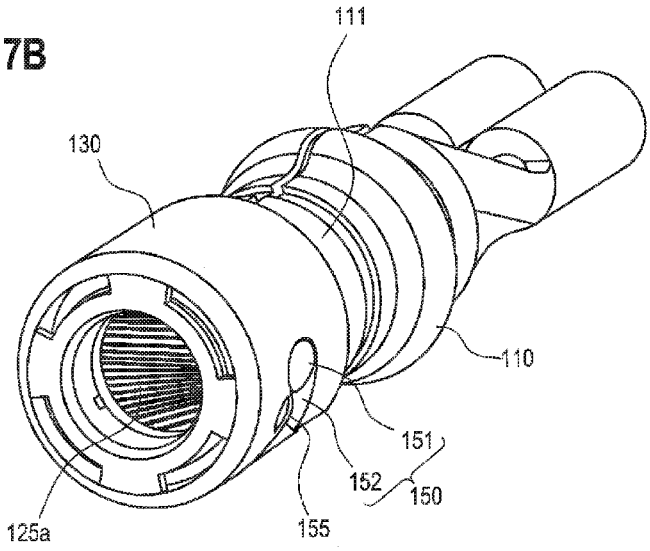
FIG. 7B is a perspective view showing a state after the rotary ring has been fixed to the contact holder by means of the fixing mechanism.
Figure 8A:
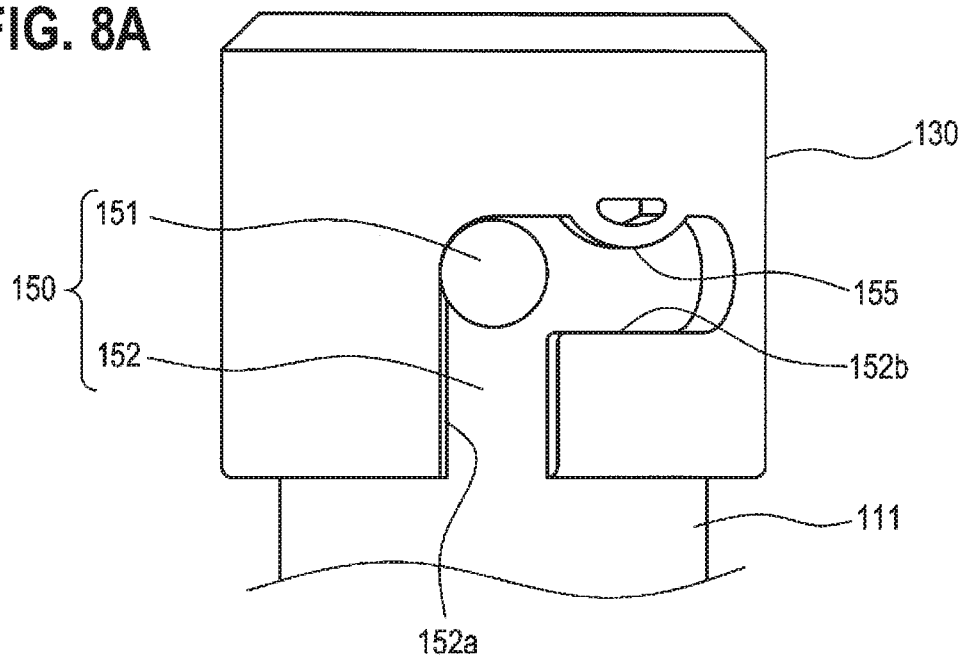
FIG. 8A is a plan view showing the fixing mechanism in a state before the rotary ring is fixed.
Figure 8B:
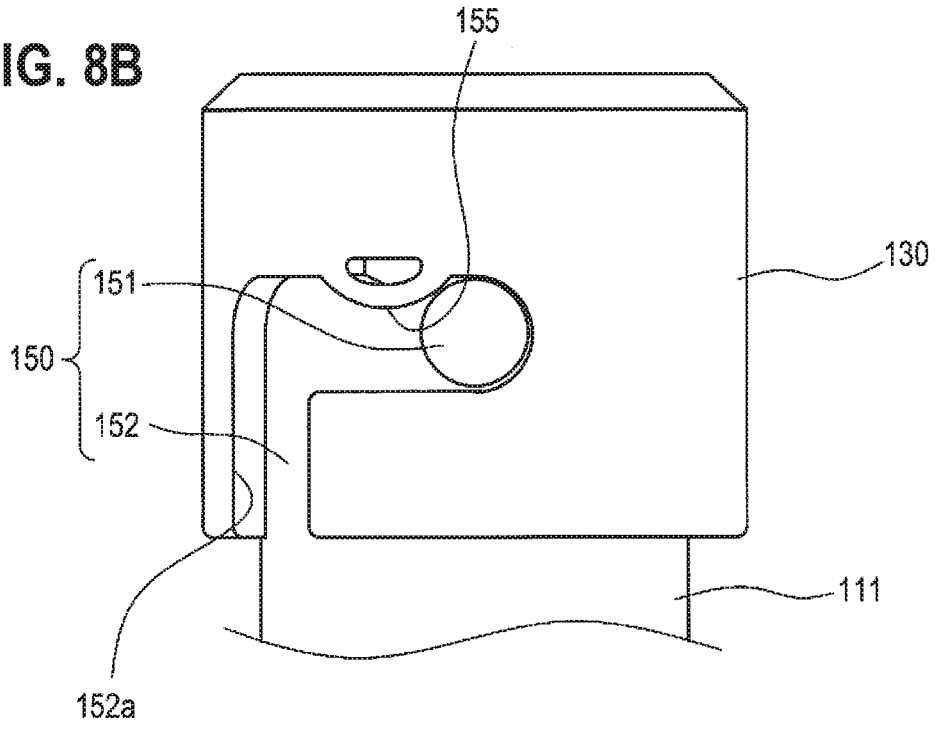
FIG. 8B is a perspective view showing the fixing mechanism in a state after the rotary ring has been fixed.
Figure 9:
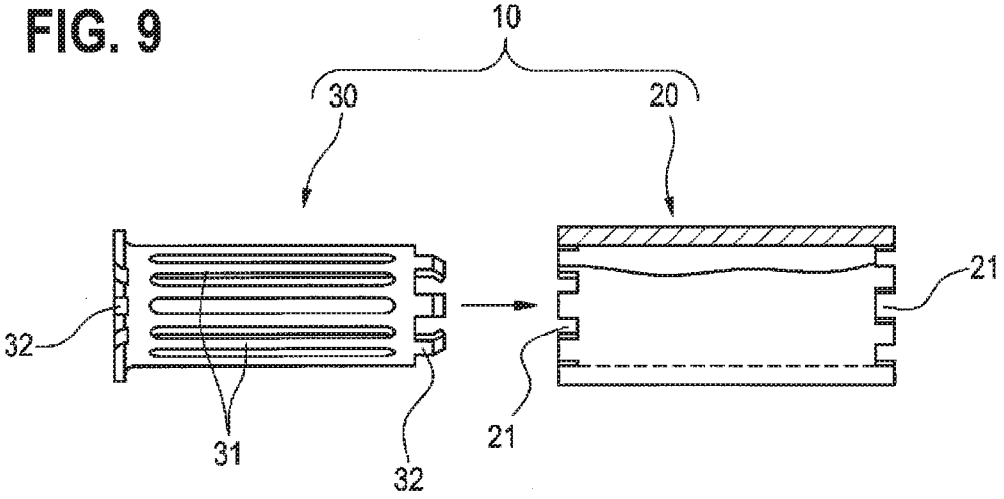
FIG. 9 is a structural view showing a conventional female terminal before assembled.
Figure 10:
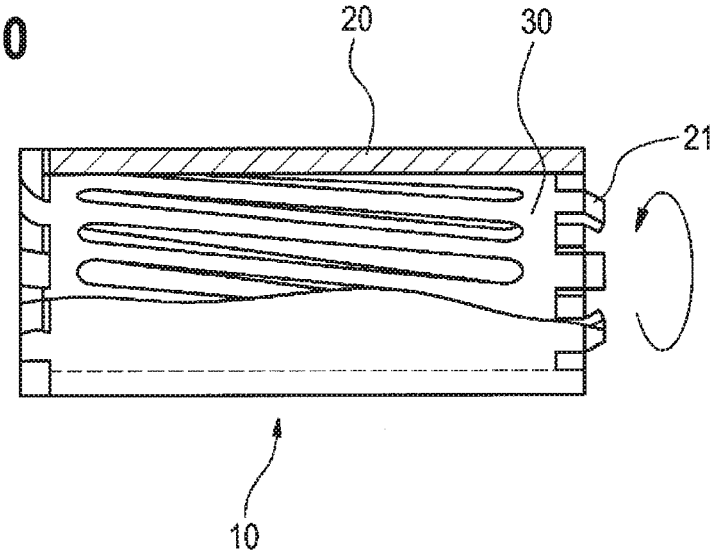
FIG. 10 is a structural view of the conventional female terminal

FIG. 1 is a perspective view showing a structure of a female terminal in the embodiment, FIGS. 2A and 2B are perspective views showing the female terminal in a state divided into halves along a sectional plane in a longitudinal direction, FIGS. 3A and 3B are perspective views showing a structure of the contact member which is used in the female terminal, FIGS. 4A and 4B are sectional side views of the female terminal, FIG. 5 is a side view showing a structure of a distal end part of a male terminal to be engaged with the female terminal, FIGS. 6A and 6B are sectional side views showing a state where the male terminal is inserted into the female terminal, FIG. 7A is a perspective view showing a state before a rotary ring is fixed to a contact holder by means of a fixing mechanism, FIG. 7B is a perspective view showing a state after the rotary ring has been fixed to the contact holder by means of the fixing mechanism, FIG. 8A is a plan view showing the fixing mechanism in a state before the rotary ring is fixed, and FIG. 8B is a perspective view of the fixing mechanism in a state after the rotary ring has been fixed. It is to be noted that in FIGS. 2A, 2B, 3A, 3B, 4A, 4B and 6A is a view showing an initial state where the contact member is not twisted, and FIG. 6B is a view showing a state where the contact member is twisted thereby to deform a diameter variable part into a hyperboloidal shape.

As shown in FIGS. 1, 2A and 2B, a female terminal 100 in the embodiment includes a terminal body 110 which has a tubular contact holder 111 at a front side and a wire crimping part 117 at a rear side, a contact member 120 which is contained inside the tubular contact holder 111 of the terminal body 110 and into which a pin-shaped male terminal is inserted from the front side, and a rotary ring 130 which is rotatably mounted to a front end of the tubular contact holder 111. All of the terminal body 110, the contact member 120 and the rotary ring 130 are formed of metal. However, the rotary ring 130 is not necessarily formed of metal, but may be formed of non-conductive material such as resin.

As shown in FIGS. 2A to 4B, the tubular contact member 120 includes a pair of holding rings 121, 122 which are provided at both ends, and a diameter variable part 125 which is held by a pair of the holding rings 121, 122 at the both ends. As shown in FIG. 4A, in an initial state, the diameter variable part 125 is so set that an inner diameter dl is larger than an outer diameter D of a pin-shaped male terminal 200 which is shown in FIG. 5, and when the holding rings 121, 122 are twisted in relatively opposite directions, the inner diameter is contracted to have a smaller diameter than the outer diameter D of the male terminal, as shown in FIG. 4B.

This diameter variable part 125 is formed as an assembly of a number of metal wires (for example, metal wires) 125*a* which are extended in an axial direction, and are arranged at a determined interval in a circumferential direction. These metal wires 125*a* are arranged at a determined interval in the circumferential direction in a state where their both ends are fixed to the holding rings 121, 122. The diameter variable part 125 is so constructed that when a pair of the holding rings 121, 122 are twisted in the relatively opposite directions, from the initial state where the metal wires are extended in parallel in the axial direction, as shown in FIGS. 3A and 4A, a hyperboloid S can be formed, as shown in FIGS. 3B and 4B.

Each of the holding rings 121, 122 is formed by rounding a narrow strip plate into a circle, leaving a small slit 121*c*, 122*c* in a circumferential direction as shown in FIGS. 3A and 3B (The slit 121*c* in the rear side holding ring 121 is provided in the same manner as the slit 122*c* in the front side holding ring 122, although not shown in FIGS. 3A and 3B). These holding rings 121, 122 which have outer diameters slightly larger than the inner diameter of the contact holder 111, in a natural state, are contained inside the contact holder 111, while elastically contracted in diameter. Then, by releasing contraction of the diameters, outer peripheries of the holding rings 121, 122 come into pressure contact with an inner periphery 112 of the contact holder 111 by their elastic repulsive forces, and thus, the contact member 120 and the terminal body 110 are kept in an electrically conductive state. It is to be noted that the inner diameters of the holding rings 121, 122 which are contained inside the contact holder 111 are of course set to be larger than the outer diameter D of the male terminal 200.

As shown in FIGS. 2A, 2B, 4A and 4B, the rear side holding ring 121 is contained and held inside the contact holder 111 so as not to rotate, but so as to move in the axial direction, because a rotation restraining rib 116 which is provided on the contact holder 111 enters into the gap 121*c* which is formed in the holding ring 121. The rotation restraining rib 116 which is provided on the contact holder 111 is set to have such an axial length that the rib 116 can be maintained in a state inserted into the gap 121*c*, even when the contact member 120 is extended or contracted in the axial direction. Because the rotation restraining rib 116 of the contact holder 111 is inserted into the gap 121*c* in the holding ring 121, the holding ring 121 is held so as not to rotate, but so as to move in the axial direction. On the other hand, the front side holding ring 122 is contained in the contact holder 111 so as to rotate.

As shown in FIGS. 2A, 2B, 4A and 4B, the rotary ring 130 has an outer peripheral cylindrical wall 131, an inner peripheral cylindrical wall 132, and an end wall 133 interconnecting the outer peripheral cylindrical wall 131 and the inner peripheral cylindrical wall 132. In a state where a front end projected part 113 of the tubular contact holder 111 is inserted between the outer peripheral cylindrical wall 131 and the inner peripheral cylindrical wall 132, an annular hook 134 of the outer peripheral cylindrical wall 131 is engaged with a stepped part in rear of the front end projected part 113. In this manner, the rotary ring 130 is rotatably mounted to a front end of the contact holder 111, in an undetachable manner.

The front side holding ring 122 of the contact member 120 is adapted to rotate together with the rotary ring 130, by engaging an engaging projection 122*a* which is projected from a front end thereof with an engaged part 135 which is formed on the inner peripheral cylindrical wall 132 of the rotary ring 130.

Then, operation will be described.

As shown in FIGS. 2A and 4A, in the initial state where the rotary ring 130 is not rotated, the inner diameter d1 of the diameter variable part 125 of the contact member 120 is set to be larger than the outer diameter D of the male terminal 200 to be inserted into the contact member 120. Therefore, when the male terminal 200 is inserted into the female terminal 100, in this state, as shown in FIG. 6A, it is possible to insert the male terminal 200 into the contact member 120 of the female terminal 100, while securing a gap between the male terminal 200 and the contact member 120. Consequently, the male terminal 200 can be inserted into the female terminal 100 with almost no friction resistance. In this manner, it is possible to reduce an insertion resistance, and also to reduce wear of the contact part.

After the male terminal 200 has been inserted into the female terminal 100, the rotary ring 130 is rotated as shown by an arrow R1 in FIG. 2B. Then, the front side holding ring 122 of the contact member 120 is rotated together, and twisted in a direction of the arrow R1 with respect to the rear side holding ring 121, as shown in FIG. 3B. Accordingly, a rear end side of the contact member 120 moves forward in the axial direction in a state where the rotation is restricted by the rear side holding ring 121 due to an action between the rotation restraining rib 116 and the gap 121*c*, and the diameter variable part 125 of the contact member 120 is contracted in diameter. Specifically, because the holding rings 121, 122 at the both ends are twisted relatively to each other, the diameter variable part 125 including a number of the metal wires 125*a* is deformed into a hyperboloidal shape. As the results, the diameter variable part 125 comes into pressure contact with the outer periphery of the male terminal 200 at a position having the smallest inner diameter d2 (<D) of the hyperboloid, as shown in FIGS. 4B and 6B.

As described above, because a number of the metal wires 125*a* come into pressure contact with the outer periphery of the male terminal 200, an electrically stabilized connection between the female terminal 100 and the male terminal 200 is established. Moreover, because a number of contact points are present along an entire circumference, temperature rise of the contact part can be reduced. Further, because a twisting angle of the diameter variable part 125 can be varied according to a rotation angle of the rotary ring 130, contact loads of the metal wires 125*a* with respect to the male terminal 200 can be varied, and hence, it is possible to easily manage a contact resistance.

Moreover, in a state where a number of the metal wires 125*a* are in pressure contact with the outer periphery of the male terminal 200, a rotation position of the rotary ring 130 with respect to the contact holder 111 is fixed. As a structure for fixing the rotation position of the rotary ring 130, any structure may be adopted, provided that the rotation position can be fixed. For example, a frictional engaging structure, a convex-concave engaging structure, a lock structure using a locking hook, and so on may be adopted.

As the structure for fixing the rotation position of the rotary ring 130, a fixing mechanism 150 as shown in FIGS. 7A, 7B, 8A and 8B, for example, can be adopted.

As shown in FIGS. 7A, 7B, 8A and 8B, the contact holder 111 is provided with a locking projection 151 having a columnar shape which is projected outward in a radial direction from a peripheral face thereof, and the rotary ring 130 is provided with a locking groove 152 in an L-shape including an axial groove 152*a* and a circumferential groove 152*b* which are formed on a peripheral face thereof. The fixing mechanism 150 is composed of the locking projection 151 and the locking groove 152. When the rotary ring 130 is mounted to the contact holder 111, in a state where the locking projection 151 of the contact holder 111 has been inserted into the axial groove 152*a* from its open end and arrived at the deepest end in the axial direction, the rotary ring 130 is rotatably mounted to the contact holder 111 thereby to be fixed in the axial position.

Along with the relative rotation of the rotary ring 130 with respect to the contact holder 111, the locking projection 151 is adapted to move inside the circumferential groove 152*b*. An elastic lock part 155 is provided in front of the deepest part in the locking groove 152. The elastic lock part 155 is so formed as to be curved in a beam-like shape and expanded into the locking groove 152. When the locking projection 151 comes into contact with the elastic lock part 155 inside the locking groove 152, the elastic lock part 155 is elastically deformed, and hence, the locking projection 151 can run across the elastic locking part 155 in a pressure contacted state. The locking projection 151 which has run across the elastic lock part 155 and has reached the deepest part in the locking groove 152 is restrained from moving further by a closed end of the locking groove 152, and also restrained from moving in the opposite direction by the elastic lock part 155. In this manner, the rotation position of the rotary ring 130 with respect to the contact holder 111 is fixed.

Because the rotation position of the rotary ring 130 with respect to the contact holder 111 is fixed by a combination of the locking projection 151 and the locking groove 152, a diameter reduced state of the diameter variable part 125 of the contact member 120 is maintained, and the electrical connection between the metal wires 125*a* and the male terminal 200 is stably maintained.

It is to be noted that the invention is not limited to the above described embodiment, but modifications, improvements, and so on can be appropriately made in the invention. Moreover, materials, shapes, sizes, numbers, positions to be provided, and so on of constituent elements in the above described embodiment are not limited, but optional, provided that the invention can be achieved.

For example, although the metal wires 125*a* are wires formed of metal in the above described embodiment, the metal wires 125*a* may be formed of metal strips (small bands) having high elasticity.

Characteristics of the female terminal in the embodiment according to the invention which has been described above will be briefly summarized and listed hereunder, in the following items [1] to [4].

[1] A female terminal (100) including a terminal body (110) having a contact holder (111) in a tubular shape at a front side, a contact member (120) in a tubular shape which is contained inside the contact holder (111) and into which a male terminal (200) is inserted from a front side, and a rotary ring (130) which is rotatably mounted to the contact holder (111), wherein the contact member (120) has a pair of holding rings (121, 122) which are provided at both ends thereof, and a diameter variable part (125) which is held by a pair of the holding rings (121, 122) at both ends thereof, an inner diameter (d1) of the diameter variable part (125) being set to be larger than an outer diameter (D) of the male terminal (200) in an initial state, and contracted to be smaller (d2) than the outer diameter (D) of the male terminal (200), by twisting a pair of the holding rings (121, 122) relatively to each other, and in a state where the contact member (120) is contained inside the contact holder (111), one (121) of the holding rings (121, 122) at the both ends is fixed to the contact holder (111) so as not to rotate, while the other holding ring (122) is fixed to the contact holder (111) so as to rotate, and also fixed to the rotary ring (130) so as to rotate integrally with the rotary ring.

[2] A female terminal (100) as described above in item [1], wherein the diameter variable part (125) includes a plurality of metal wires (125*a*) which are arranged at an interval in a circumferential direction in a state where their both ends are fixed to the holding rings (121, 122), and extended in parallel with an axial direction of the contact member (120) in the initial state, and when a pair of the holding rings (121, 122) are twisted relatively to each other, the metal wires (125*a*) are formed into a hyperboloid (S) as a whole from the initial state.

[3] A female terminal (100) as described above in item [1] or [2], wherein there is provided a fixing mechanism (150) for fixing a rotation position of the rotary ring (130) with respect to the contact holder (111), when the male terminal (200) is inserted into the contact member (120) and electrically connected.

[4] A female terminal (100) as described above in item [3], wherein the fixing mechanism (150) has a locking projection (151) which is provided on a peripheral face of the contact holder (111), and a locking groove (152) which is provided on a peripheral face of the rotary ring (130) and receives the locking projection (151) thereby to restrain movement in a rotation direction.

Although the invention has been described in detail referring to the specified embodiment, it is apparent to those skilled in the art that various modifications and amendments can be added to the invention without deviating from the sprit and scope of the invention.

According to the invention, such an advantage that it is possible to provided a female terminal capable of reducing a friction resistance when a male terminal is inserted thereby to reduce an insertion load, and at the same time, to reduce wear of a contact part is achieved. The invention achieving this advantage is useful for the female terminal into which a pin-shaped male terminal is inserted from the front side.

What is claimed is:

1. A female terminal comprising:

a terminal body having a contact holder in a tubular shape at a front side of the terminal body;

a contact member in a tubular shape which is contained inside the contact holder and into which a male terminal is inserted from a front side of the contact holder; and a rotary ring which is rotatably mounted to the front side of the contact holder, wherein the contact member has a pair of holding rings which are provided at both ends thereof, and a diameter variable part which is held by a pair of the holding rings at both ends thereof, an inner diameter of the diameter variable paint being set to be larger than an outer diameter of the male terminal in an initial state, and contracted to be smaller than the outer diameter of the male terminal, by the rotary ring for twisting a pair of the holding rings relatively to each other, and in a state where the contact member is contained inside the contact holder, one of the holding rings at the both ends is fixed to the contact holder so as not to rotate, while the other holding ring is fixed to the contact holder so as to rotate, and fixed to the rotary ring so as to rotate integrally with the rotary ring when the rotary ring is rotated.

2. The female terminal according to claim 1, wherein the diameter variable part includes a plurality of metal wires which are arranged at an interval in a circumferential direction in a state where their both ends are fixed to the holding rings, and extended in parallel with an axial direction of the contact member in the initial state, and when a pair of the holding rings are twisted relatively to each other, the metal wires are formed into a hyperboloid as a whole from the initial state.

3. The female terminal according to claim 1 further comprising a fixing mechanism for fixing a rotation position of the rotary ring with respect to the contact holder, when the male terminal is inserted into the contact member and electrically connected.

4. The female terminal according to claim 3, wherein the fixing mechanism has a locking projection which is provided on a peripheral face of the contact holder, and a locking groove which is provided on a peripheral face of the rotary ring and receives the locking projection thereby to restrain movement in a rotation direction.

* * * * *